United States Patent [19]

Ellis et al.

[11] 4,409,728

[45] Oct. 18, 1983

[54] METHOD OF MAKING A STABLE HIGH VOLTAGE DC VARISTOR

[75] Inventors: Howard F. Ellis, Stephentown, N.Y.; James S. Kresge, Pittsfield, Mass.

[73] Assignee: General Electric Company, N.Y.

[21] Appl. No.: 274,030

[22] Filed: Jun. 15, 1981

Related U.S. Application Data

[62] Division of Ser. No. 201,182, Oct. 27, 1980, Pat. No. 4,317,101.

[51] Int. Cl.[3] ..... H01C 17/02

[52] U.S. Cl. ..... 29/613; 29/621; 427/101

[58] Field of Search ..... 338/20, 21; 427/101, 427/389.7, 397.7; 361/127; 252/518; 29/610, 613, 621

[56] References Cited

U.S. PATENT DOCUMENTS

| | | | |
|---|---|---|---|
| 3,959,543 | 5/1976 | Ellis | 252/518 |
| 4,046,847 | 9/1977 | Kresge | 264/61 |
| 4,148,135 | 4/1979 | Sakshaug et al. | 29/621 |

*Primary Examiner*—Carl E. Hall
*Assistant Examiner*—P. W. Echols
*Attorney, Agent, or Firm*—Robert A. Cahill

[57] ABSTRACT

A high voltage varistor for DC operation is manufactured by applying a glass collar to the perimeter of a sintered zinc oxide disc and heat treated between about 750° C. and 400° C. for several cycles in air. After heat treating, an organic resin or ceramic coating is applied to the glass collar to further insulate the varistor for high voltage application.

5 Claims, 2 Drawing Figures

METHOD OF MAKING A STABLE HIGH VOLTAGE DC VARISTOR

This is a division, of application Ser. No. 201,182, filed 10-27-80, now U.S. Pat. No. 4,317,101.

BACKGROUND OF THE INVENTION

U.S. Pat. No. 4,046,847 issued Sept. 6, 1977 discloses a method for rendering zinc oxide varistors stable for AC operation. U.S. patent application Ser. No. 967,196, filed Dec. 7, 1978, now U.S. Pat. No. 4,243,622, issued Jan. 6, 1981, discloses a method for rendering a zinc oxide varistor stable by means of a single heat treatment application.

U.S. patent application Ser. No. 161,935, filed June 23, 1980, now abandoned, discloses the use of an insulating glass collar around the periphery of zinc oxide varistors to prevent the varistors from becoming unstable in the presence of a nonoxidizing gas.

U.S. Pat. No. 3,959,543, issued May 25, 1976 describes a specific glass composition for providing an insulating collar to zinc oxide varistors.

Aforementioned U.S. Pat. No. 4,046,847 describes the instability problems that occur when zinc oxide varistors are used without a post sinter heat treating process. The instability is caused by changes in the "bulk" conductivity through the bulk region of the disc when the disc is used in an AC voltage application. When the disc is used in a DC voltage application it is found that "bulk" instability occurs to some extent whereas, "rim" instability occurs to a much greater extent. When the varistor is subjected to a source of DC voltage, after heat treating the varistor as described in the aforementioned U.S. Pat. No. 4,046,847, the bulk region of the disc remains relatively stable whereas the rim region of the disc rapidly becomes unstable. For purposes of this disclosure "rim" instability is defined as the instability that occurs in the region of the vicinity of the varistor rim whereas "bulk" instability occurs in the remaining region through the varistor.

Varistors having glass rims are found to be limited to a particular voltage level above which the insulating properties of the glass are insufficient to prevent flashover from occurring between opposite electrode faces of the varistor. A coating of an inorganic resin or ceramic material is therefore required to make the varistors suitable for high voltage applications. However, when the organic resin or ceramic material is heated above a specified temperature to cure the resin or set the ceramic, the high voltage discs become unstable when subjected to DC voltages.

The purpose of this invention is to describe methods and materials for rendering high voltage resistors stable under DC voltage conditions.

SUMMARY OF THE INVENTION

High voltage stable DC varistors are provided by applying a glass collar around the varistor rim and heat treating the glass rimmed varistor for at least one cycle between 400° C. and 750° C. An organic resin is applied to the outer surface of the glass collar and the resin is heated up to 400° C. to cure the resin. If a ceramic material is applied over the glass collar the ceramic is heated up to 500° C.

DESCRIPTION OF THE PREFERRED EMBODIMENT

Figure 1:
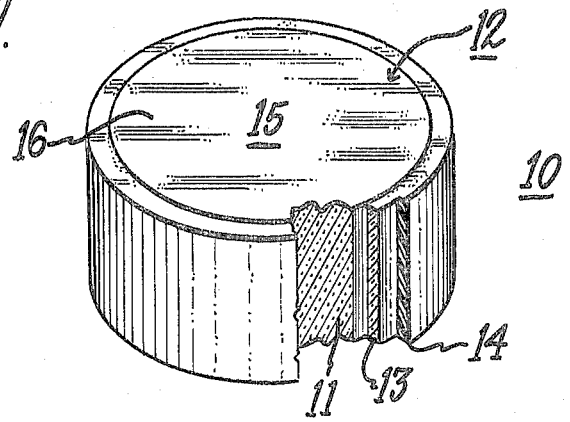
FIG. 1 is a front perspective view, in partial section, of a high voltage DC varistor according to the invention.

FIG. 1 shows a varistor 10 consisting of sintered zinc oxide disc 11 containing a pair of metal electrodes 12 on opposing surfaces. A glass collar 13 is provided around the perimeter of disc 11 to prevent electrical breakdown from occurring between opposite electrodes 12. In order to use varistor 10 in high voltage applications where several thousand volts are applied to opposing electrodes 12, an insulating coating 14 is applied over the surface of glass collar 13. When varistor 10 is used for high voltage DC applications, electrical instability can occur through bulk region 15 and along rim region 16 as described earlier. Bulk instability is caused by the decrease in the resistance properties of bulk region of disc 11 when varistor 10 is subjected to DC voltages for continuous periods of time. Rim instability occurs in the vicinity of rim region 16 covered by glass collar 13 and is caused by the decrease in the resistive property of disc 11 in the vicinity of glass collar 13. Bulk instability is believed to be caused by the degradation in the resistive properties of the zinc oxide components used to form the bulk region 15 of disc 11, whereas rim instability is believed caused by the degradation in the resistive properties of the zinc oxide material immediately subjacent glass collar 13.

It is found, for example, that when insulating coating 14 is omitted and a varistor 10 containing a glass collar 13 is heat treated by raising the temperature of the zinc oxide disc 11 up to 750° C. for one hour and reduced to 400° C., and recycled back to 750° C. for at least one cycle before cooling to room temperature, the resulting varistor 10 remains stable when operated in air to several thousand hours.

When insulating coating 14 is applied to glass collar 13 and is subsequently heated to cure the insulating material, the varistors become unstable after a few hundred operating hours. By instability is meant the rapid increase in watts loss that occurs when a fixed voltage is applied across the discs' electrodes. When the unstable varistors were examined to determine the cause of instability, it was discovered that bulk region 15 remained relatively stable whereas rim region 16 was substantially unstable.

Figure 2:
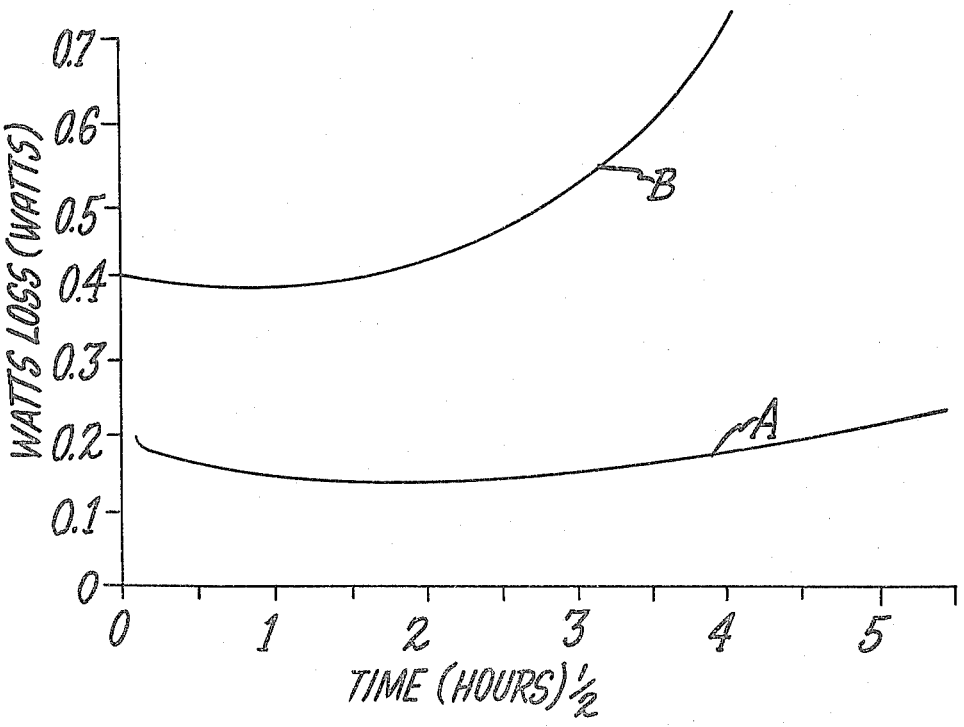
FIG. 2 is a graphic representation of the watts loss as a function of time for the varistor of FIG. 1 compared to a prior art varistor.

Variations in both the thermal heat treatment temperature and the time of treatment showed that rim region 16 is highly susceptible to degradation when heated in excess of 500° C. This is shown in FIG. 2 where varistors were heated to 500° C. at A and were compared to varistors from the same sample batch that were heated to 600° C. at B.

Varistors heated at intermediate ranges between 500° C. and 600° C. showed proportionate increases in watts loss both initially and after a period of several hours of operation.

Materials such as polyamide imide enamels and synthetic alkyd organic resins as described in aforementioned patent application, Ser. No. 161,935, can be applied over glass collar 13 and treated for curing at temperatures up to 400° C. without causing rim instability to occur.

When a ceramic insulating coating having the composition as described in the aforementioned U.S. Pat. No. 4,046,847, for example, is applied over glass rim 13 to form ceramic coating 14, (FIG. 1) and is cured at a temperature less than 500° C., the varistors exhibit the stability shown at A in FIG. 2. Application of insulating collar 14 directly on the surface of zinc oxide disk 11, by omitting glass rim 13, has not heretofore proved effective for DC high voltage operation.

We claim:

1. A method for providing a zinc oxide varistor having stable electrical characteristics when subjected to DC voltages comprising the steps of:

applying a glass collar to the outer perimeter of a zinc oxide varistor disc;

applying a pair of metal electrodes on opposite surfaces of said disc;

heat treating the collared disc by raising said disc to a temperature of about 750° C. for one hour;

cooling the heated collared disc to less than 400° C.;

coating an insulating material on the surface of said glass collar; and heating the heated collared disc to an elevated temperature up to 500° C. to cure the insulating coating.

2. The method of claim 1 including the steps of reheating the collared disc to 750° C. for one hour before applying said insulating coating.

3. The method of claim 2 wherein said insulating coating comprises a ceramic cured at a temperature up to 500° C.

4. The method of claim 2 wherein said insulating coating comprises an organic resin cured at a temperature up to 400° C.

5. A method for providing zinc oxide varistors having good stability when operated under DC voltage comprising the steps of:

applying a pair of metal electrodes on opposing surfaces of a sintered zinc oxide disc;

applying a glass collar around the perimeter of said disc;

heating the collared disc to about 750° C. for one hour;

cooling the heated collared disc to about 400° C.;

reheating the heated collared disc to about 750° C. for one hour;

cooling the reheated collared disc to less than 400° C;

applying an insulating coating of ceramic material on said glass collar; and heating the reheated collared disc to an elevated temperature up to 500° C. to cure the ceramic coating.

* * * * *